US006101470A

United States Patent [19]

Eide et al.

[11] Patent Number: 6,101,470

[45] Date of Patent: Aug. 8, 2000

[54] METHODS FOR GENERATING PITCH AND DURATION CONTOURS IN A TEXT TO SPEECH SYSTEM

[75] Inventors: Ellen M. Eide; Robert E. Donovan, both of Mount Kisco, N.Y.

[73] Assignee: International Business Machines Corporation, Armonk, N.Y.

[21] Appl. No.: 09/084,679

[22] Filed: May 26, 1998

[51] Int. Cl.[7] ..... G10L 13/08

[52] U.S. Cl. ..... 704/260; 704/268

[58] Field of Search ..... 704/260, 266, 704/267, 268

[56] References Cited

U.S. PATENT DOCUMENTS

| | | | |
|---|---|---|---|
| 3,704,345 | 11/1972 | Coker et al. | 704/266 |
| 4,278,838 | 7/1981 | Antonov | 704/260 |
| 4,908,867 | 3/1990 | Silverman | 704/260 |
| 5,384,893 | 1/1995 | Hutchins | 704/260 |
| 5,536,171 | 7/1996 | Javkin et al. | 434/185 |
| 5,758,320 | 5/1998 | Asano | 704/258 |
| 5,913,193 | 6/1999 | Huang et al. | 704/258 |

OTHER PUBLICATIONS

Xuedong Huang, A. Acero, J. Adcock, Hsiao–Wuen Hon, J. Goldsmith, Jingsong Liu, and M. Plumpe, "Whistler: A Trainable Text–to–Speech System," Proc. Fourth Int. Conf. Spoken Language, 1996. ICSLP 96, vol. 4, pp. 2387–2390, Oct.3–6, 1996.

Campbell et al., Stress, Prominence, and Spectral Tilt, ESCA Workshop on Intonation: Theory, Models and Applications, Athens Greece, Sep. 18–20, 1997, pp. 67–70.

Huang et al. Recent Improvements on Microsoft's Trainable Text–to–Speech System–Whistler, 1997 IEEE, pp. 959–962; ICASSP–97, Apr. 21–24.

Donovan et al., Improvements in an HMM–Based Synthesizer, ESCA Eurospeech '95.4th European Conference on Speech Communication and Technology, Madrid, Sep. 1995, pp. 573–576.

G. David Forney, Jr.; The Viterbi Algorithm, Proceedings of the IEEE, vol. 61, No. 3, Mar. 1973, pp. 268–278.

*Primary Examiner*—David R. Hudspeth
*Assistant Examiner*—Donald L. Storm
*Attorney, Agent, or Firm*—F. Chau & Associates, LLP

[57] ABSTRACT

A method for automatically generating pitch contours in a text to speech (TtS) system, the system converting input text into an output acoustic signal simulating natural speech, the method comprising the steps of: storing a plurality of associated stress and pitch level pairs, each of the plurality of pairs including a lexical stress level and a pitch level; calculating lexical stress levels of the input text; comparing the stress levels of the input text to the stored stress levels of the plurality of associated stress and pitch level pairs to find the stored stress levels closest to the stress levels of the input text; and copying the pitch levels associated with the closest stored stress levels of the stress and pitch level pairs to generate the pitch contours of the input text. Features illustrative of various modes of the invention include stress and pitch level pairs that correspond with the end of vowels, use of a phonetic dictionary to expand words to phonemes and concatenate stress levels, blocking sentences and the stress contours into constant or variable lengths by segmenting from the ends toward the beginnings, and averaging at the block boundary. The method may distinguish among declarations, questions, and exclamations. Training text may be collected from more than one speaker and scaled; the speaker(s) may wear a laryngograph to provide vocal cord activity.

41 Claims, 6 Drawing Sheets

A: Albuquerque, New Mexico is a popular destination.

B: AE! L B AX) K ER@ K IY) N UW! M EH! K S IX) K OW@ IH! Z EY! P AA! P Y AX) L ER) D EH@ S T IX) N EY! SH IX) N

C: 2 0 1 0 2 2 0 1 2 2 2 0 0 1 0 2 0

D: 2 0 1 0 2 | 2 0 1 2 2 2 | 0 0 1 0 2 0

E: (Lexical Stress, Pitch) Database

| | | |
|---|---|---|
| 2 1 0 0 2 2 2 0<br>110 95 78 102 111 101 115 104 | 0 1 0 1 2<br>92 94 100 97 102 | 1 0 0 2 2 2<br>106 101 98 87 100 114 |
| | | 2 0 2 1 2 2<br>102 95 96 103 119 111 |
| 2 2 0 2 1<br>98 101 116 101 96 | 0 2 2 1 2<br>115 93 99 102 114 | 0 0 2 2 2 0<br>101 110 98 102 105 119 |
| | | 1 0 2 1 2 0<br>99 97 102 108 114 97 |
| | 0 1 0 2<br>114 101 97 112 | 2 2 1 0 0 2<br>86 99 103 98 105 95 |
| | | 1 0 1 0 2 0<br>101 112 98 106 97 99 |

F: 110 114 101 97 112 106 101 98 87 100 114 101 112 98 106 97 99

G: 110 114 101 97 112 122 101 83 87 100 114 86 112 98 106 97 99

FIG. 6

METHODS FOR GENERATING PITCH AND DURATION CONTOURS IN A TEXT TO SPEECH SYSTEM

BACKGROUND OF THE INVENTION

1. Technical Field

The present invention relates to speech synthesis and, more particularly, to methods for generating pitch and duration contours in a text to speech system.

2. Discussion of Related Prior Art

Speech generation is the process which allows the transformation of a string of phonetic and prosodic symbols into a synthetic speech signal. Text to speech systems create synthetic speech directly from text input. Generally, two criteria are requested from text to speech (TtS) systems. The first is intelligibility and the second, pleasantness or naturalness. Most of the current TtS systems produce an acceptable level of intelligibility, but the naturalness dimension, the ability to allow a listener of a synthetic voice to attribute this voice to some pseudo-speaker and to perceive some kind of expressivity as well as some indices characterizing the speaking style and the particular situation of elocution, is lacking. However, certain fields of application require maximal realism and naturalism such as, for example, telephonic information retrieval. As such, it would be valuable to provide a method for instilling a high degree of naturalness in text to speech synthesis.

For synthesis of natural-sounding speech, it is essential to control prosody. Prosody refers to the set of speech attributes which do not alter the segmental identity of speech segments, but instead affect the quality of the speech. An example of a prosodic element is lexical stress. It is to be appreciated that the lexical stress pattern within a word plays a key role in determining the way that word is synthesized, as stress in natural speech is typically realized physically by an increase in pitch and phoneme duration. Thus, acoustic attributes such a pitch and segmental duration patterns indicate much about prosodic structure. Therefore, modeling them greatly improves the naturalness of synthetic speech.

However, conventional speech synthesis systems do not supply an appropriate pitch to synthesized speech. Instead, flat pitch contours are used corresponding to a constant value of pitch, with the resulting speech waveforms sounding unnatural, monotone, and boring to listeners.

Early attempts to provide a speech synthesis system with pitch typically involved the use of rules derived from phonetic theories and acoustic analysis. The non-statistical, rule-based approaches suffer from their inability to learn from training data, thereby encompassing rigid systems which are unable to adapt to a specific style of speech or speaker characteristic without a complete re-write of the rules by a speech expert. More recent work on prosody in speech synthesis has taken a statistical approach (e.g., linear regressive analysis and tree regression analysis).

Implementing a non-constant pitch contour and varying the durations of individual phonemes has the potential to dramatically increase the quality of synthesized speech. Accordingly, it would be desirable and highly advantageous to provide methods for generating pitch and duration contours in a text to speech system.

SUMMARY OF THE INVENTION

According to one aspect of the invention there is provided a method for generating pitch contours in a text to speech system, the system converting input text into an output acoustic signal simulating natural speech, the method comprising the steps of: storing a plurality of associated stress and pitch level pairs, each of the plurality of pairs including a stress level and a pitch level; calculating the stress levels of the input text; comparing the stress levels of the input text to the stored stress levels of the plurality of associated stress and pitch levels pairs to find the stored stress levels closest to the stress levels of the input text; and copying the pitch levels associated with the closest stored stress levels of the stress and pitch level pairs to generate the pitch contours of the input text. The stress level and the pitch level of each of the plurality of pairs correspond to an end time of a vowel.

According to another aspect of the invention there is provided a method for generating duration contours in a text to speech (TtS) system, the system converting input text into an output acoustic signal simulating natural speech, the input text including a plurality of input sentences, the method comprising the steps of: training a pitch contour model based on a plurality of training sentences having words associated therewith to obtain a sequence of stress and pitch level pairs for each of the plurality of training sentences, the pairs including a stress level and a pitch level corresponding to the end of a syllable; calculating a stress contour of each of the plurality of input sentences by utilizing a phonetic dictionary, the dictionary having entries associated with words to be synthesized, each entry including a sequence of phonemes which form a word, and a sequence of stress levels corresponding to the vowels in the word, the stress contour being calculated by expanding each word of each of the plurality of input sentences into constituent phonemes according to the dictionary and concatenating the stress levels of the words in the dictionary forming each of the plurality of input sentences; and adjusting durations of the phonemes forming the words of the input sentences based on the stress levels associated with the phonemes to generate the duration contours.

These and other objects, features and advantages of the present invention will become IQ apparent from the following detailed description of illustrative embodiments thereof, which is to be read in connection with the accompanying drawings.

BRIEF DESCRIPTION OF THE DRAWINGS

FIG. 6 is a diagram illustrating the construction of a pitch contour for a given input sentence to be synthesized according to an embodiment of the invention.

DETAILED DESCRIPTION OF PREFERRED EMBODIMENTS

Figure 1:
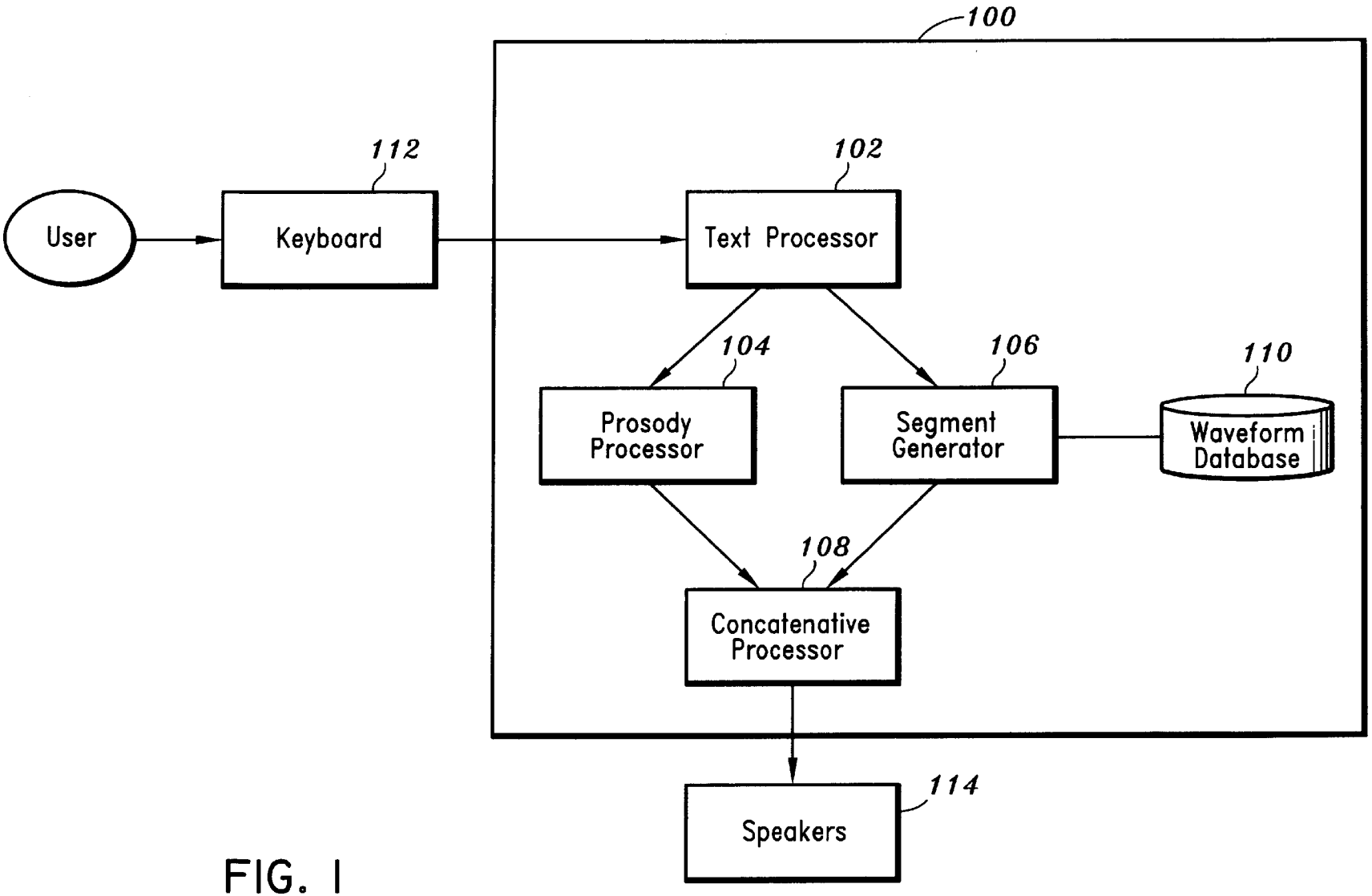
FIG. 1 is a block diagram of a text to speech system according to an embodiment of the invention.

Referring initially to FIG. 1, a block diagram is shown of a text to speech system (synthesizer) 100 according to an embodiment of the invention. The system 100 includes a text processor 102 and a concatenative processor 108, both processors being operatively coupled to a prosody generator 104 and a segment generator 106. The system also includes a waveform segment database 110 operatively coupled to segment generator 106. Additionally, a keyboard 112 is operatively coupled to text processor 102, and a speaker(s) 114 is operatively coupled to concatenative processor 108. It is to be appreciated that the method of the invention is usable with any text to speech system (e.g., rule-based, corpus-based) and is not, in any way, limited to use with or dependent on any details or methodologies of any particular text to speech synthesis arrangement. In any case, it should be understood that the elements illustrated in FIG. 1 may be implemented in various forms of hardware, software, or combinations thereof. As such, the main synthesizing elements (e.g., text processor 102, prosody generator 104, segment generator 106, concatenative processor 108, and waveform segment database 110) are implemented in software on one or more appropriately programmed general purpose digital computers. Each general purpose digital computer may contain, for example, a central processing unit (CPU) operatively coupled to associated system memory, such as RAM, ROM and a mass storage device, via a computer interface bus. Accordingly, the software modules performing the functions described herein may be stored in ROM or mass storage and then loaded into RAM and executed by the CPU. As a result, FIG. 1 may be considered to include a suitable and preferred processor architecture for practicing the invention which may be achieved by programming the one or more general purpose processors. Of course, special purpose processors may be employed to implement the invention. Given the teachings of the invention provided herein, one of ordinary skill in the related art will be able to contemplate these and various other implementations of the elements of the invention.

A brief explanation of the functionality of the components of the text to speech system 100 will now be given. The keyboard 112 is used to input text to be synthesized to text processor 102. The text processor then segments the input text into a sequence of constituent phonemes, and maps the input text to a sequence of lexical stress levels. Next, the segment generator chooses for each phoneme in the sequence of phonemes an appropriate waveform segment from waveform database 110. The prosody processor selects the appropriate pitch and duration contours for the sequence of phonemes. Then, the concatenative processor 108 combines the selected waveform segments and adjusts their pitch and durations to generate the output acoustic signal simulating natural speech. Finally, the output acoustic signal is output to the speaker 114.

Speech signal generators can be classified into the following three categories: (1) articulatory synthesizers, (2) formant synthesizers, and (3) concatenative synthesizers. Articulatory synthesizers are physical models based on the detailed description of the physiology of speech production and on the physics of sound generation in the vocal apparatus. Formant synthesis is a descriptive acoustic-phonetic approach to synthesis. Speech generation is not performed by solving equations of physics in the vocal apparatus, but rather by modeling the main acoustic features of the speech signal. Concatenative synthesis is based on speech signal processing of natural speech databases (training corpora). In a concatenative synthesis system, words are represented as sequences of their constituent phonemes, and models are built for each phoneme. Since all words are formed from these units, a word can be constructed for which no training data (i.e., spoken utterances serving as the basis of the models of the individual phonemes) exists by rearranging the phoneme models in the appropriate order. For example, if spoken utterances of the words "bat" and "rug" are included in the training data, then the word "tar" can be synthesized from the models for "t" and "a" from "bat" and "r" from "rug". The pieces of speech corresponding to these individual phonemes are hereinafter referred to as "waveform segments".

In the embodiment of the invention illustrated in FIG. 1, the synthesizer employed with the invention is a concatenative synthesizer. However, it is to be appreciated that the method of the invention is usable with any synthesizer and is not, in any way, limited to use with or dependent on any details or methodologies of any particular synthesizer arrangement.

Figure 2:
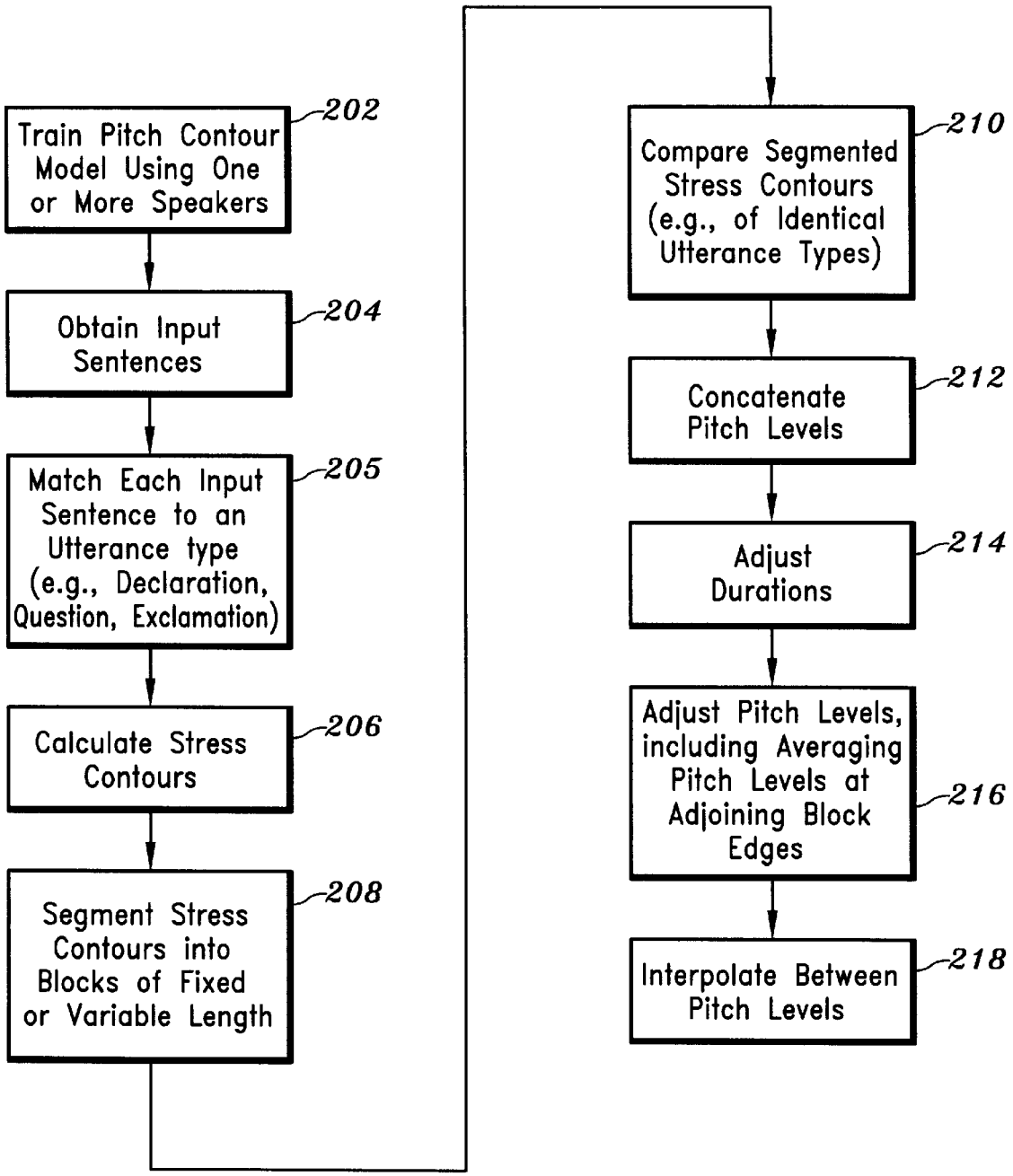
FIG. 2 is a flow chart illustrating a method for generating pitch and duration contours in a text to speech system according to an embodiment of the invention.

Referring to FIG. 2, a flow chart is shown of a method for generating pitch and duration contours in a text to speech system according to an embodiment of the invention. It is to be appreciated that the term stress as used herein refers to lexical stress. The method includes the step of training a pitch contour model (step 202) to obtain a pool of stress and pitch level pairs. Each pair includes a stress level and a pitch level corresponding to a vowel in a word. The model is based on the reading of a training text by one or more speakers. The training text includes a plurality of training sentences. The training of the model includes calculating the stress and pitch contours of the training sentences, from which the pool of stress and pitch level pairs is obtained. The training of the pitch model is described in further detail with respect to FIG. 3.

After training the pitch contour model, the input text to be synthesized, which includes a plurality of input sentences, is obtained (step 204). Match each input sentence to an utterance type (e.g. declaration, question, exclamation). Then, the stress contour of each input sentence is calculated (step 206). This involves expanding each word of each input sentence into its constituent phonemes according to a phonetic dictionary, and concatenating the stress levels of the words in the dictionary forming each input sentence.

The phonetic dictionary contains an entry corresponding to the pronunciation of each word capable of being synthesized by the speech synthesis system. Each entry consists of a sequence of phonemes which form a word, and a sequence of stress levels corresponding to the vowels in the word. Lexical stress as specified in the dictionary takes on one of the following three values for each vowel: unstressed, secondary stress, or primary stress. A small portion of the synthesis dictionary is shown in Table 1 for the purpose of illustration. In the left column is the word to be synthesized, followed by the sequence of phonemes which comprise it. Each vowel in the acoustic spelling is marked by "!" if it carries primary lexical stress, by "@" if it carries secondary stress, and by ")" if unstressed, as specified by the PRONLEX dictionary (see Release 0.2 of the COMLEX English pronouncing lexicon, Linguistic Data Consortium, University of Pennsylvania, 1995). Each word may have any number of unstressed or secondary stressed vowels, but only one vowel carrying primary stress.

TABLE 1

Examples of lexical stress markings

| | |
|---|---|
| ABSOLUTELY | AE@ B S AX) L UW! T L IY) |
| ABSOLUTENESS | AE@ B S AX) L UW! T N IX) S |
| ABSOLUTION | AE@ B S AX) L UW! SH IX) N |

TABLE 1-continued

| Examples of lexical stress markings | |
|---|---|
| ABSOLUTISM | AE@ B S AX) L UW! T IH@ Z AX) M |
| ABSOLVE | AX)B Z AO! L V |

The next step of the method, which is required in order to later compare the stress levels of the stress contours of the input and training sentences in blocks, is to segment the stress contours of both the input and training sentences (step 208). The segmentation involves aligning the ends of the stress contours of the input and training sentences, and respectively segmenting the stress contours from the ends toward the beginnings. The result of segmentation is a plurality of stress contour input blocks respectively aligned with a plurality of stress contour training blocks. That is, for every input block, there will be a corresponding number of aligned training blocks. The number of training blocks which are aligned to a single input block after segmentation generally equals the number of training sentences used to train the pitch model. It is to be appreciated that the size of the blocks may correspond to a predefined number of syllables or may be variable, as explained further hereinbelow.

Then, the stress levels of each input block are respectively compared to the stress levels of each aligned training block in order to obtain a sequence of training blocks having the closest stress levels to the compared input blocks for each input sentence (step 210). This comparison is further described with respect to FIG. 5.

It is to be appreciated that each stress level in a training block corresponds to a stress level in a stress and pitch level pair and thus, is associated with a particular pitch level. Thus, having obtained a sequence of training blocks for each input sentence in step 210, the pitch levels associated with the stress levels of each sequence of training blocks are concatenated to form pitch contours for each input sentence (step 212).

The durations of the phonemes forming the words of the input sentences are then adjusted based on the stress levels associated with the phonemes (step 214). This adjustment is further described with respect to FIG. 5.

Additionally, each pitch level of the pitch contours formed in step 212 is adjusted if its associated stress level does not match the corresponding stress level of the corresponding input block (step 216). This adjustment is further described with respect to FIG. 5. Step 216 may also include averaging the pitch levels at adjoining block edges, as described more fully below. After the pitch levels have been adjusted, the remainder of each pitch contour is calculated by linearly interpolating between the specified pitch levels (step 218).

Figure 3:
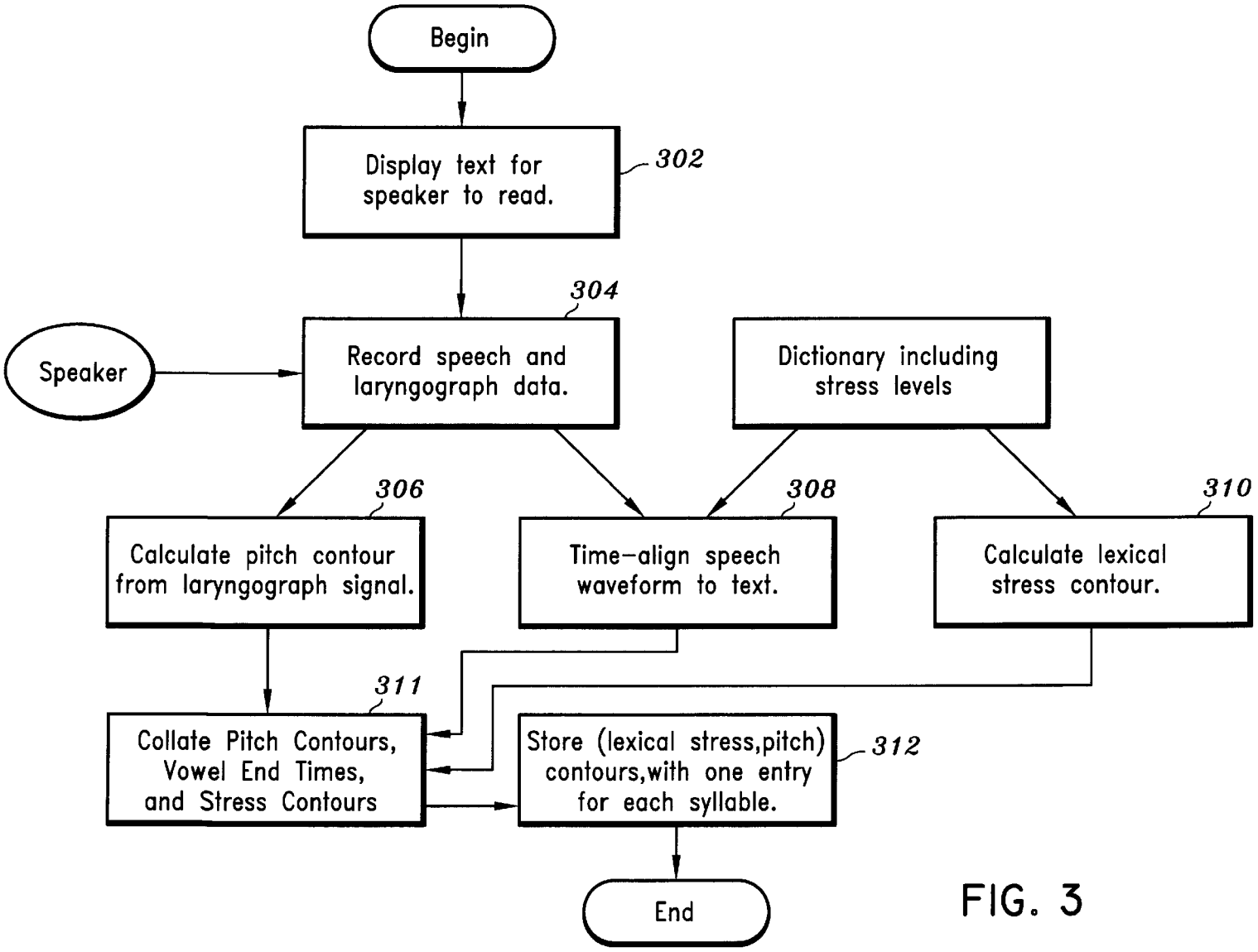
FIG. 3 is a flow chart illustrating the training of a pitch contour model according to an embodiment of the invention.

Referring to FIG. 3, a flow chart is shown of a procedure for training the pitch model according to an illustrative embodiment of the invention. The first step is to collect data from a chosen speaker(s). Thus, a training text of training sentences is displayed for the speaker(s) to read (step 302). In the illustrative embodiment, the text consists of 450 training sentences, and the speaker(s) is a male, as the male voice is easier to model than the female voice. However, it is to be understood that the invention is usable with one or more speakers and further, that the speaker(s) may be of either gender. In order to collect data from the speaker, the speaker reads the training sentences while wearing a high-fidelity, head-mounted microphone as well as a neck-mounted laryngograph. The laryngograph, which consists of two electrodes placed on the neck, enables vocal chord activity to be monitored more directly than through the speech signal extracted from the microphone. The impedance between the electrodes is measured; open vocal chords correspond to high impedance while closed vocal chords result in a much lower value. As the laryngograph signal is very clean, this apparatus supplies a very clear measurement of pitch as a function of time. The speech and laryngograph signals corresponding to the reading of the text are simultaneously recorded (step 304).

It is to be appreciated that while the quality of the synthesized speech improves with the number of training utterances available for selecting the pitch contour to be synthesized, the use of only lexical stress contours as features for selecting the pitch contour enables a relatively small, efficiently-searched database of pitch contours to suffice for very good quality prosody in synthesis. Thus, while the above example describes the use of 450 training sentences, a smaller number of sentences may be used to advantageously achieve a natural sounding acoustic output. An actual test revealing how the number of training utterances affects the quality of synthesized pitch is shown in Table 2 hereinbelow.

Post-processing of the collected data includes calculating the pitch as a function of time from the laryngograph signal by noting the length of time between impulses (step 306), and performing a time alignment of the speech data to the text (step 308). The alignment may be performed using, for example, the well known Viterbi algorithm (see G. D. Forney, Jr., "The Viterbi Algorithm", Proc. IEEE, vol. 61, pp. 268–78, 1973). The aligmnment is performed to find the times of occurrence of each phoneme and thus each vowel. The alignment is also used to derive the ending times of each vowel.

Next, the stress contour of each training sentence is calculated (step 310) by expanding each word of each training sentence into its constituent phonemes according to the dictionary, and concatenating the stress levels of the words in the dictionary forming each training sentence. Each vowel in an utterance contributes one element to the stress contour: a zero if it is unstressed, a one if it corresponds to secondary stress, or a two if it is the recipient of primary lexical stress. The set {0, 1, 2} correspond to the designations {")", "@", "!"}, respectively, as specified by the PRONLEX dictionary (see Release 0.2 of the COMLEX English pronouncing lexicon, Linguistic Data Consortium, University of Pennsylvania, 1995). Unstressed labels are applied to vowels which carry neither primary nor secondary stress.

Collating the pitch contours, vowel end times, and stress contours (step 311) enables us to store a series of (lexical stress, pitch) pairs, with one entry for the end of each syllable (step 312). That is, each syllable generates a (lexical stress, pitch) pair consisting of the pitch at the end time of its vowel as well as the vowel's lexical stress level. Evidence from linguistic studies (see, for example, N. Campbell and M. Beckman, "Stress, Prominence, and Spectral Tilt", ESCA Workshop on Intonation: Theory, Models and Applications, Athens, Greece, Sep. 18–20, 1997) indicates that the pitch during a stressed segment often rises throughout the segment and peaks near its end; this fact motivates our choice of specifying the pitch at the end of each vowel segment.

The stored sequences of (lexical stress, pitch) pairs constitute our pitch model and will be used for constructing the pitch contours of utterances to be synthesized. In speech synthesis, the (lexical stress, pitch) pairs generated from the training utterances are used to find the closest lexical stress patterns in the training pool to that of the utterance to be synthesized and to copy the associated pitch values therefrom, as described more fully below.

Figure 4:
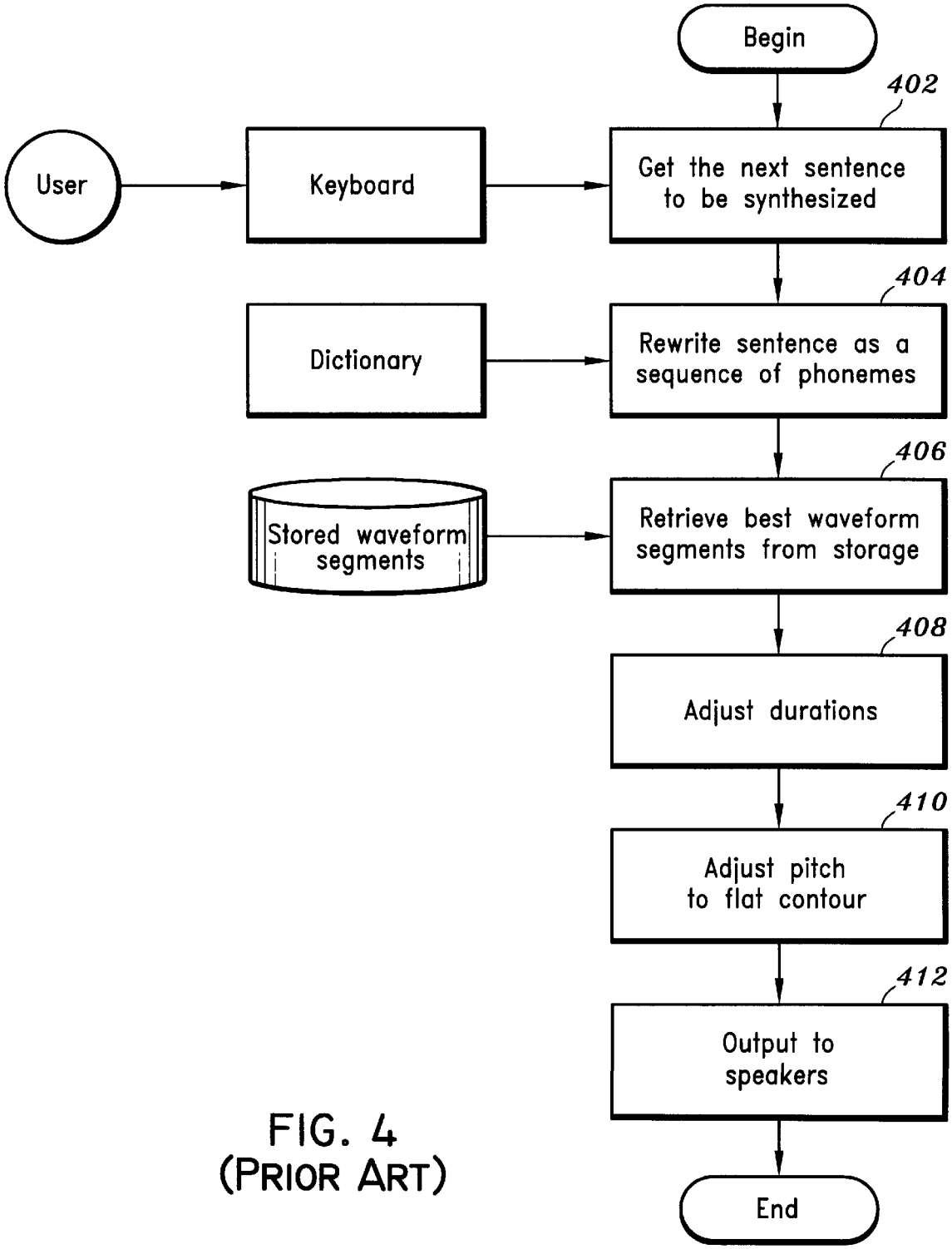
FIG. 4 (PRIOR ART)
FIG. 4 is a flow chart illustrating the operation of a conventional, flat pitch, text to speech system.

However, before describing a speech synthesis system according to the invention, a flow chart illustrating a conventional text to speech system which uses a constant (flat) pitch contour is shown in FIG. 4. Using a keyboard, a user enters an input text consisting of input sentences he wishes to be synthesized (step 402). Each word in each of the input sentences is expanded into a string of constituent phonemes by looking in the dictionary (step 404). Then, waveform segments for each phoneme are retrieved from storage and concatenated (step 406). The procedure by which the waveform segments are chosen is described in the following article: R. E. Donovan and P. C. Woodland, "Improvements in an HMM-Based Speech Synthesizer", Proceedings Eurospeech 1995, Madrid, pp. 573–76. Subsequently, the duration of each waveform segment retrieved from storage is adjusted (step 408). The duration of each phoneme is specified to be the average duration of the phoneme in the training corpus plus a user-specified constant $\alpha$ times the standard deviation of the duration of that phonemic unit. The $\alpha$ term serves to control the rate of the synthesized speech. Negative $\alpha$ corresponds to synthesized speech which is faster that the recorded training speech, while positive a corresponds to synthesized speech which is slower than the recorded training speech. Next, the pitch of the synthesis waveform is adjusted to flat (step 410) using the PSOLA technique described in the above referenced article by Donovan and Woodland. Finally, the waveform is output to the speaker (step 412).

Figure 5:
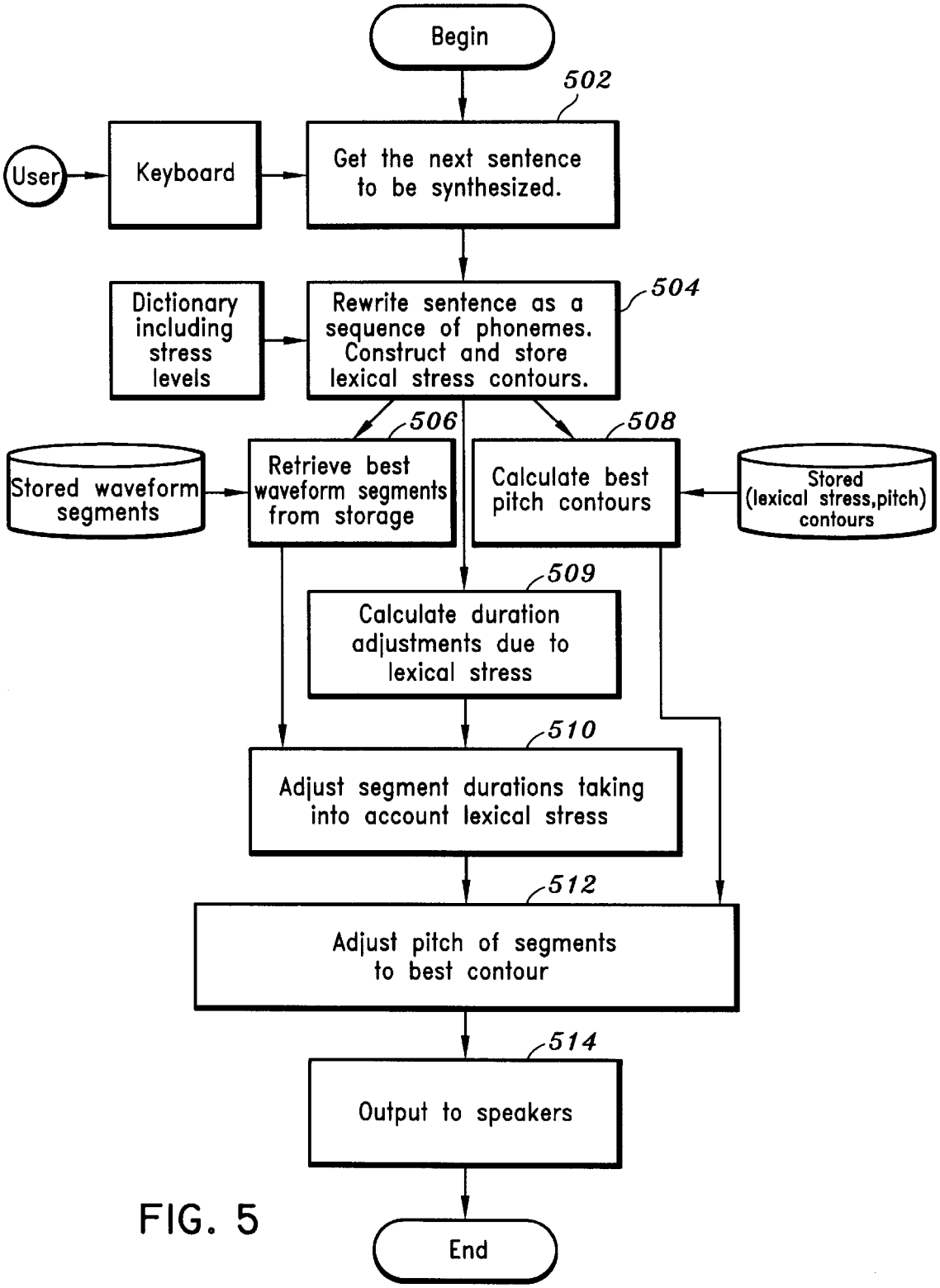
FIG. 5 is a flow chart illustrating the operation of a text to speech system according to an embodiment of the invention.

FIG. 5 is a flow chart illustrating the operation of a speech synthesis system according to an embodiment of the invention. In the system of FIG. 5, the (lexical stress, pitch) pairs stored during the training of the pitch model are used to generate pitch contours for synthesized speech that are used in place of the flat contours of the conventional system of FIG. 4.

Referring to FIG. 5, the user enters the input text consisting of the input sentences he wishes to be synthesized (step 502), similar to step 402 in the conventional system of FIG. 4. In addition to expanding each word of each input sentence into its constituent phonemes as was done in step 404 of FIG. 4, we also construct the lexical stress contour of each input sentence from the dictionary entry for each word and then store the contours (step 504). Steps 502 and 504 are performed by the text processor 102 of FIG. 1.

Waveform segments are retrieved from storage and concatenated (step 506) by segment generator 106 in exactly the same manner as was done in step 406 of FIG. 4. However, in the synthesis system according to the invention, the prosody processor 104 uses the lexical stress contours composed in step 504 to calculate the best pitch contours from our database of (lexical stress, pitch) pairs (step 508). A method of constructing the best pitch contours for synthesis according to an illustrative embodiment of the invention will be shown in detail in FIG. 6.

Next, adjustments to the segment durations are calculated by prosody processor 104 based on the lexical stress levels (step 509), and then, the durations are adjusted accordingly by segment generator 106 (step 510). Calculating the adjustments of the segment durations involves calculating all of the durations of all of the phonemes in the training corpus. Then, in order to increase the duration of each phoneme which corresponds to secondary or primary stress, the calculated duration of each phoneme carrying secondary stress is multiplied by a factor $\rho$, and the calculated duration of each phoneme carrying primary stress is multiplied by factor $\tau$. The factors $\rho$ and $\tau$ are tunable parameters. We have found that setting $\rho$ equal to 1.08 and $\tau$ equal to 1.20 yields the most natural sounding synthesized speech. Alternatively, we could calculate the values of $\rho$ and $\tau$ from the training data by calculating the average durations of stressed phonemes and comparing that to the average duration taken across all phonemes, independent of the stress level. Considering lexical stress in the duration calculation increases the naturalness of the synthesized speech.

Then, rather than adjusting the pitch of the concatenated waveform segments to a flat contour as was done in step 410 of FIG. 4, the segment generator 106 utilizes the PSOLA technique described in the article by Donovan and Woodland referenced above to adjust the waveform segments in accordance with the pitch contours calculated in step 508 (step 512). Finally, the waveform is output to the speaker (step 514), as was done in step 412 of FIG. 4.

An example of how the pitch contour is constructed for a given utterance is shown in FIG. 6. In panel A, the input sentence to be synthesized, corresponding to step 502 of FIG. 5, is shown. In panel B, the input sentence is expanded into its constituent phonemes with the stress level of each vowel indicated. This line represents the concatenation of the entries of each of the words in the phonetic dictionary. In panel C, the lexical stress contour of the sentence is shown. Each entry is from the set {0, 1,2} and represents an unstressed, secondary, or primary stressed syllable, respectively. Unstressed syllables are indicated by ")" in the dictionary (as well as in panel B), secondary stress is denoted as "@", and primary stress is represented by "!". Panel C corresponds to the lexical stress contours stored in step 504 of FIG. 5.

Panels D, E, F, and G represent the internal steps in calculating the best pitch contour for synthesis as in step 508 of FIG. 5. These steps are explained generally in the following paragraphs and then described specifically with reference to the example of FIG. 6.

The best pitch contour of an input sentence to be synthesized is obtained by comparing, in blocks, the stress contour of the input sentence to the stress contours of the training sentences in order to find the (training) stress contour blocks which represent the closest match to the (input) stress contour blocks. The closest training contour blocks are found by computing the distance from each input block to each (aligned) training block. In the illustrative embodiment of FIG. 6, the Euclidean distance is computed. However, it is to be appreciated that the selection of a distance measure herein is arbitrary and, as a result, different distance measures may be employed in accordance with the invention.

As stated above, the stress contours are compared in blocks. Because the ends of the utterances are critical for natural sounding synthesis, the blocks are obtained by aligning the ends of the contours and respectively segmenting the contours from the ends towards the beginnings. The input blocks are then compared to the aligned training blocks. The comparison starts from the aligned end blocks and respectively continues to the aligned beginning blocks. This comparison is done for each set of input blocks corresponding to an input sentence. Proceeding in blocks runs the risk of introducing discontinuities at the edges of the blocks and not adequately capturing sequence information when the blocks are small. Conversely, too long a block runs the risk of not being sufficiently close to any training sequence. Accordingly, for the above described database of 450 utterances, a blocksize of 10 syllables has been determined to provide the best tradeoff.

It is to be appreciated that, in any given block, if the training utterance to which the desired contour (i.e., input contour) is being compared is not fully specified (because the training sentence has fewer syllables than the input sentence to be synthesized), a fixed penalty is incurred for each position in which no training value is specified. For example, if we utilize a block size of 6 (where a "." indicates the termination of a block), and the input utterance has a stress contour of 2 0 2 1 2 . 1 0 0 2 2 2 . 1 0 1 2 2 0 . 0 1 2 2 2 2 and one of the training utterances has a stress contour of 2 2 . 2 0 2 2 2 0 . 1 2 0 2 2 0 . 0 2 1 2 2 2 then to find the pitch contour for the left-most block we will need to compare the input stress contour block [2 0 2 1 2] to the training stress contour block [2 2]. Accordingly, we compute the distance of [1 2] to [2 2], which is 1, and then we add a fixed penalty, currently set to 4, for the three remaining positions, giving a total distance of 13. If this proves to be the smallest distance in the training database, we would take the final contour to be the nominal pitch value of the training speaker, for example 110 Hz, for the first 3 positions and then the values associated with the chosen contour for the remaining 2 positions in this block.

Once the sequence of training blocks having stress levels closest to the stress levels of the compared input blocks has been obtained for an input sentence, the corresponding pitch values of the sequence of training blocks are concatenated to form the pitch contour for that input sentence. Further, once the closest stress contour training block is found for a particular portion of the input contour, a check is made for discrepancies between the training block and input contour stress levels. If a discrepancy is present, then the resulting pitch value is adjusted to correct the mismatch. Thus, if the training stress level is higher than the input stress level at a given position, the pitch value is decreased by a tunable scale factor (e.g., 0.85). On the other hand, if the training stress level is lower than desired, the corresponding pitch value is increased (e.g, by a factor of 1.15).

After these adjustments, the contours of the individual blocks are concatenated to form the final pitch contour. Once the values of the pitch contour have been specified at the end of each vowel, the remainder of the contour is created by linearly interpolating between the specified values.

Returning to the example of FIG. 6, in panel D, the lexical stress contour of the sentence to be synthesized is broken into blocks of a fixed blocksize (here, taken to be six) starting from the end of the sentence. The left-most block will be of size less than or equal to six depending on the total number of syllables in the sentence.

Panel E represents the stored (lexical stress,pitch) contour database assembled in step 312 of FIG. 3. For the purposes of illustration, we show a database of three training contours; the system we implemented contained 450 such contours. The training contours are blocked from the ends of the sentences using the same blocksize as in panel D.

The right-most block of the lexical stress contour of the input sentence to be synthesized is compared with the right-most block of each of the training stress contours. The Euclidean distance between the vectors is computed and the training contour which is closest to the desired (i.e., input) contour is noted. In our example, the third contour has the closest right-most block to the right-most block of the sentence to be synthesized; the distance between the best contour and the desired contour is 1 for this right-most block.

Next, the block to the left of the right-most block is considered. For this block, the first contour matches best.

Finally, the left-most block is considered. In this case, the third training contour is incomplete. Accordingly, we compute the distance of the existing values and add 4, the maximum distance we can encounter on any one position, for each missing observation. Thus, the distance to the third contour is 4, making it closer than either of the other training contours for this block.

In panel F, we concatenate the pitch values from the closest blocks to form a pitch contour for the sentence to be synthesized. The missing observation from the left-most position of the left-most block of the third contour is assigned a value equal to the nominal pitch of our training speaker, 110 Hz in this case.

Finally, in panel G we adjust the values of the contour of panel F at positions where the input contour and the closest training contour disagree. Values of the pitch at positions where the associated input stress contour has higher stress than the closest training stress contour are increased by a factor of 1.15 (e.g., the left-most position of the center block). Similarly, values of the pitch at positions where the input contour has lower stress than the closest training stress contour are reduced by a factor of 0.85 (e.g., the left-most entry of the right-most block). The contour of panel G forms the output of step 512 of FIG. 5.

The invention utilizes a statistical model of pitch to specify a pitch contour having a different value for each vowel to be synthesized. Accordingly, the invention provides a statistical approach to the modeling of pitch contours and duration relying only on lexical stress for use in a text to speech system. An attempt to achieve naturalness in synthetic S which is similar in spirit is described in the article by X. Huang, et al., entitled "Recent Improvements on Microsoft's Trainable Text to speech System—Whistler", appearing ir Proceedings ICASSP 1997, vol. II, pp. 959–62. However, the invention's approach to generating pitch differs from previously documented work in several ways. First, whet Huang, et al., a comparison is performed on the basis of a complicated set of features including parts-of-speech and grammatical analysis, we use only lexical stress to compute distances between utterances. Secondly, we maintain that the end of the utterance contributes more to the naturalness of synthesized speech than other portions and that adjacency in time is important. Thus, we compare the end of the lexical stress pattern for the input utterance with the end of each training utterance and proceed backwards in time aligning syllables one by one, rather than allowing time-warped alignments starting from the beginnings of utterances. We work in blocks of syllables rather than complete utterances in order to make more efficient use of a rather small pool of training utterances. Finally, we make adjustments to the final pitch contour when the closest training utterance has a different lexical stress level than the input utterance.

It is to be appreciated that the invention may be utilized for multiple types of utterances. In our original implementation, our training speaker spoke only declarative sentences. Thus, this was the only type of sentence whose prosody we could model and therefore the only type for which we could successfully generate a pitch contour in synthesis.

However, a simple modification enables the modeling of prosody for questions as well as for declarations. We collect data from a speaker reading a set of questions and store the resulting (lexical stress, pitch) contours separately from those stored for declarative sentences. In synthesis, if we find a question mark at the end of an utterance to be synthesized we search the set of (lexical stress, pitch) contours gathered from questions to find an appropriate contour. Otherwise we index the declarative contours.

Expanding on this idea, we can collect data from various types of utterances, for example, exclamations, those exhibiting anger, fear, and joy, and maintain a distinct pool of training contours for each of these types of utterances. In synthesis, the user specifies the type of emotion he wishes to convey through the use of a special symbol in the same way that "?" denotes a question and "!" denotes an exclamation.

It is to be understood that multiple training speakers may utilized to train the pitch contour model. Thus, despite having collected pitch data from a single speaker, the same person whose speech data was used to build the synthesis system, this need not be the case. Pitch data could be collected from a number of different speakers if desired, with the data from each scaled by multiplying each pitch value by the ratio of the desired average value divided by that speaker's average pitch value. This technique enables the amassing of a large, varied database of pitch contours without burdening a single speaker for many hours of recordings.

Accordingly, a separate database for each of the desired training speakers can be created, where each database includes pitch, stress contours from a single speaker. We identify one speaker as a desired "target" speaker and calculate the average value of his pitch, P_target.

Then, for each training speaker "s" other than the target speaker, we calculate his average pitch P_s. Next, we multiply each pitch value in s's database by (P_target/P_s) so that the scaled pitch values average to P_target. Finally, we combine the target speaker's pitch, stress data with all other speaker's scaled pitch, stress data to form a large database of contours whose average pitch is that of the target speaker.

It is to be appreciated that the blocks lengths may be variable. Thus, despite having designated all blocks as a fixed length in the above example, a simple modification may be made to allow for variable length blocks. In such a case, a block would be allowed to continue past its nominal boundary as long as an exact match of the desired lexical stress contour to a training contour can be maintained. This would partially resolve ties in which more than one training stress contour matches the desired contour exactly. In particular, variable-length blocks would increase the chances of retrieving the original pitch contour when synthesis of one of the training sentences is requested by the user. In the embodiments described above, the approach used was to choose the first of these contours encountered to provide the pitch contour.

It is to be further appreciated that discontinuities in pitch across the edges of the blocks may be minimized, if so desired. Several techniques can be employed to reduce the effect of the block edge. A simple idea is to filter the output, for example, by averaging the value at the edge of the block with the value at the edge of the adjacent block. More elegantly, we could embed the block selection in a dynamic programming framework, including continuity across block edges in the cost function, and finding the best sequence of blocks to minimize the cost.

Results of the Invention

We assessed the naturalness of synthetic speech with and without including a synthesized pitch track by subjective listening tests. We concluded that inclusion of the synthesized pitch contours increases the naturalness of the output speech, and the quality increases with the size of the pool of training utterances.

The duration of stressed vowels is increased by a tuned multiplicative factor; we have found an increase of 20% for vowels carrying primary stress and 8% for those with secondary stress to work well.

TABLE 2

Effects of training database size on quality of synthesized pitch

| Number of Training Utterances | Score |
|---|---|
| 0 | 0 |
| 1 | 38 |
| 5 | 46 |
| 20 | 50 |
| 100 | 51 |
| 225 | 59 |
| 450 | 54 |

Shown in Table 2 is the result of a listening test meant to determine the effect of the size of the training corpus on the resulting synthesis. Each input utterance was synthesized with a block size of 10 under a variety of training database sizes and presented to a listener in random order. The listener was asked to rate the naturalness of the pitch contour on a scale of 0 (terrible) to 9 (excellent.)

The left column in Table 2 indicates the number of training utterances which were available for comparison with each input utterance. A value of zero in the left column indicates the synthesis was done with flat pitch, while a value of one indicates a single contour was available, so that every input utterance was given the same contour. On each occasion of an utterance synthesized with flat pitch, the listener marked that utterance with the lowest possible score. We see that as the number of choices grew the listener's approval increased, flattening at 225. This flattening indicates a slightly larger block size may yield even better quality synthesis, given the tradeoff between smoothness across concatenated blocks and the minimum distance within a block from the pool of training stress patterns to that of the input utterance.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A method for generating pitch contours in a text to speech (TtS) system, the system converting input text into an output acoustic signal simulating natural speech, the method comprising the steps of:

(a) storing a plurality of associated stress and pitch level pairs, each of the plurality of pairs including a lexical stress level and a pitch level;

(b) determining lexical stress levels of the input text;

(c) comparing the stress levels of the input text to the stored stress levels of the plurality of associated stress and pitch levels pairs to find the stored stress levels closest to the stress levels of the input text; and (d) copying the pitch levels associated with the closest stress levels of the stress and pitch level pairs to generate the pitch contours of the input text.

2. The method of claim 1, wherein the stress level and the pitch level of each of the plurality of pairs correspond to an end time of a vowel.

3. The method of claim 1, wherein the stress level is one of a zero stress level corresponding to no stress, a first stress level corresponding to secondary stress, and a second stress level corresponding to primary stress.

4. The method of claim 1, wherein said storing step further comprises the step of training a pitch contour model based on a training text read by at least one speaker to generate the plurality of stress and pitch level pairs, the training text comprising a plurality of training sentences, the plurality of pairs further comprising a plurality of sequences of stress and pitch level pairs, each sequence corresponding to one of the plurality of training sentences.

5. The method of claim 4, wherein said step of training the pitch contour model comprises the steps of:

(a) recording speech data and laryngograph data corresponding to the reading of the training sentences by the at least one speaker;

(b) calculating the pitch contour of each of the plurality of training sentences;

(c) time-aligning the speech data to the training text to determine an end-time for each vowel;

(d) calculating the stress contour of each of the plurality of training sentences; and (e) collating the pitch contours, syllable end-times, and stress contours to generate the sequence of stress and pitch level pairs for each of the plurality of training sentences.

6. The method of claim 5, wherein the pitch contour of each of the plurality of training sentences is calculated from the laryngograph data as a function of time by noting a length of time between impulses.

7. The method of claim 5, wherein the speech data is time-aligned to the training text using the Viterbi algorithm.

8. The method of claim 5, wherein said step of calculating the stress contour of each of the plurality of training sentences comprises the steps of:

(a) expanding each word of each of the plurality of training sentences into constituent phonemes according to a phonetic dictionary, the dictionary having a plurality of entries, each entry associated with a word to be synthesized and comprising a sequence of phonemes which form the word and a sequence of stress levels corresponding to vowels in the word; and (b) concatenating the stress levels of the words in the dictionary forming each of the plurality of training sentences.

9. The method of claim 5, wherein the training sentences are read by a first and a second speaker, average values of the pitch of the first and second speakers are calculated, and the pitch levels corresponding to the second speaker are multiplied by the average value of the pitch of the first speaker and divided by the average value of the pitch of the second speaker.

10. The method of claim 1, wherein the input text comprises a plurality of input sentences, and the step of calculating the stress levels of the input text comprises the steps of:

(a) expanding each word of each of the plurality of input sentences into constituent phonemes according to a phonetic dictionary, the dictionary having a plurality of entries, each entry associated with a word to be synthesized and comprising a sequence of phonemes which form the word and a sequence of stress levels corresponding to vowels in the word; and (b) copying the stress levels of the words in the dictionary forming each of the plurality of input sentences.

11. The method of claim 1, wherein the input text comprises a plurality of input sentences and the plurality of pairs corresponds to a plurality of training sentences read by at least one speaker, said comparing step comprising:

(a) segmenting stress contours of the input and training sentences by aligning the ends of the stress contours and respectively segmenting the stress contours from the ends toward the beginnings, to generate a plurality of stress contour input blocks respectively aligned with a plurality of stress contour training blocks, the stress contours including a plurality of stress levels, the ends of the stress contours corresponding to the ends of the sentences; and (b) respectively comparing the stress levels of each of the plurality of input blocks to the stress levels of each of the plurality of aligned training blocks to obtain a sequence of aligned training blocks having the closest stress levels to the compared input blocks for each of the plurality of input sentences.

12. The method of claim 11, wherein said step of respectively comparing the stress levels of each of the plurality of input blocks to the stress levels of each of the plurality of aligned training blocks further comprises the steps of:

calculating a distance between vectors representative of each of the plurality of input blocks to vectors representative of each of the aligned training blocks to obtain the aligned training block having the closest distance to the compared input block for each of the plurality of input blocks, the distance calculation starting from the input block and aligned training blocks corresponding to the end of the input sentence and respectively continuing to the input block and aligned training blocks corresponding to the beginning of the input sentence, for each of the plurality of input sentences; and concatenating the aligned training blocks having the shortest distances to the respectively compared input blocks for each of the plurality of input sentences.

13. The method of claim 12, wherein the calculated distance between vectors is a Euclidean distance.

14. The method of claim 12, herein the stress contour input and training blocks are the same blocksize.

15. The method of claim 12, wherein the blocksize corresponds to a predefined number of syllables.

16. The method of claim 12, wherein the stress contour input and training blocks are of variable length.

17. The method of claim 16, wherein the variable block length corresponds to a nominal number of predefined syllables plus an additional number of syllables, the nominal number and the additional number of syllables corresponding to a maximum number of syllables that allow an exact match between the stress levels of the input block and the stress levels of the aligned training block.

18. The method of claim 11, wherein the step of comparing the stress levels of each of the plurality of input blocks to the stress levels of each of the aligned training blocks compares stress levels corresponding to an identical utterance type.

19. The method of claim 18, wherein the utterance type is one of a declaration, a question, and an exclamation.

20. The method of claim 11, wherein the pitch level at an edge of the block in the sequence of training blocks is averaged with the pitch level at the edge of a following block.

21. The method of claim 1, wherein the copying step further comprises concatenating the copied pitch levels to generate the pitch contours of the input text.

22. The method of claim 1, further comprising the step of adjusting the pitch levels associated with the closest stress levels when the closest stress levels do not exactly match the corresponding stress levels of the input text.

23. The method of claim 22, wherein said adjusting step comprises the steps of:

multiplying the pitch levels associated with the closest stress levels by a first factor, when the closest stress levels are less than the corresponding stress levels of the input text; and multiplying the pitch levels associated with the closest stress levels by a second factor, when the closest stress levels are greater than the corresponding stress levels of the input text.

24. The method of claim 23, wherein the first factor equals 1.15 and the second factor equals 0.85.

25. The method of claim 22, further comprising the step of linearly interpolating between the adjusted pitch levels forming an adjusted pitch contour to calculate a remainder of each adjusted pitch contour.

26. The method of claim 1, wherein the input text includes a plurality of phonemes, the method further comprising the step of adjusting the durations of the phonemes of the input text based on the stress levels associated with the phonemes.

27. The method of claim 26, wherein the stress level associated with a phoneme is one of a zero stress level corresponding to no stress, a first stress level corresponding to secondary stress, and a second stress level corresponding to primary stress.

28. The method of claim 27, wherein said adjusting step further comprises the steps of:

(a) multiplying the durations of each of the plurality of phonemes having the first stress level by a third factor; and (b) multiplying the durations of each of the plurality of phonemes having the second stress level by a fourth factor.

29. The method of claim 28, wherein the third factor equals 1.08 and the fourth factor equals 1.20.

30. The method of claim 28, wherein the third factor is calculated by dividing an average duration of the plurality of phonemes, independent of the stress level, by an average duration of the phonemes having secondary stress.

31. The method of claim 28, wherein the fourth factor is calculated by dividing an average duration of the plurality of phonemes, independent of the stress level, by an average duration of the phonemes having primary stress.

32. The method of claim 1, further comprising the step of storing the stress levels of the input text in a database.

33. The method of claim 1, wherein the input text includes a plurality of input sentences, the stored stress and pitch level pairs correspond to a plurality of training sentences, and the training and input sentences correspond to a plurality of utterance types.

34. The method of claim 33, wherein each of the plurality of utterance types is identified by a special symbol at an end of one of the training and input sentences.

35. A method for generating duration contours in a text to speech (TtS) system, the system converting input text into an output acoustic signal simulating natural speech, the input text including a plurality of phonemes, the method comprising the steps of:

determining lexical stress levels of the input text; and adjusting the durations of the phonemes of the input text by multiplying the durations of each of the plurality of phonemes having a stress level corresponding to primary or secondary lexical stress by a first or a second factor, respectively.

36. The method of claim 35 wherein a phoneme has one of no stress, the secondary lexical stress, and the primary lexical stress.

37. The method of claim 35, wherein the first factor equals 1.08 and the second factor equals 1.20.

38. The method of claim 35, wherein the first factor is calculated by dividing an average duration of the plurality of phonemes, independent of the stress level, by an average duration of the phonemes having associated secondary stress.

39. The method of claim 35, wherein the fourth factor is calculated by dividing an average duration of the plurality of phonemes, independent of the stress level, by an average duration of the phonemes having associated primary stress.

40. A method for generating pitch contours in a text to speech (TtS) system, the system converting input text into an output acoustic signal simulating natural speech, the input text including a plurality of input sentences, the method comprising the steps of:

storing a plurality of associated pitch and lexical stress level pairs based on a plurality of training sentences;

determining a stress contour of each of the plurality of input sentences;

segmenting the stress contours of the input and training sentences into a plurality of stress contour input blocks and stress contour training blocks, respectively, by aligning the ends of the input and training stress contours and respectively segmenting the input and training stress contours from the ends towards the beginnings, the ends of the stress contours corresponding to the ends of the sentences;

respectively comparing the stress levels of each of the plurality of input blocks to the stress levels of each of the aligned training blocks to obtain a sequence of training blocks having the closest stress levels to the compared input blocks for each the plurality of input sentences; and concatenating the pitch levels of the stress and pitch level pairs associated with the sequence of training blocks for each of the plurality of input sentences to form pitch contours for each of the plurality of input sentences.

41. A method for generating pitch contours in a text to speech (TtS) system, the system converting input text into an output acoustic signal simulating natural speech, the input text including a plurality of input sentences, the method comprising the steps of:

(a) storing a pool of associated stress and pitch level pairs corresponding to a plurality of training sentences read by at least one speaker, each pair having a lexical stress level and a pitch level associated therewith;

(b) generating a lexical stress contour for each of the plurality of input sentences, the stress contours having a plurality of lexical stress levels associated therewith; and (c) constructing the pitch contour for each of the plurality of input sentences by locating stress levels in the pool similar to the stress levels of the stress contour of each of the plurality of input sentences and copying the associated pitch levels.

* * * * *